United States Patent [19]

Cargill

[11] 4,018,155

[45] Apr. 19, 1977

[54] BALLISTIC PRINT HAMMER ASSEMBLY

[75] Inventor: N. Allen Cargill, Warminster, Pa.

[73] Assignee: Mohawk Data Sciences Corporation, Herkimer, N.Y.

[22] Filed: June 2, 1975

[21] Appl. No.: 583,010

[52] U.S. Cl. ..... 101/93.33; 101/93.34; 335/229; 335/255

[51] Int. Cl.[2] ..... B41J 9/30

[58] Field of Search ..... 101/93.14, 93.48, 93.09, 101/93.28–93.36, 93.48; 197/1 R; 335/238, 251, 258, 273, 274, 276

[56] References Cited

UNITED STATES PATENTS

| | | | |
|---|---|---|---|
| 2,686,470 | 8/1954 | Gore et al. | 101/93.33 |
| 2,901,969 | 9/1959 | Rabinow | 101/93.34 |
| 3,077,830 | 2/1963 | Paige | 101/93.33 |
| 3,117,256 | 1/1964 | Gamblin | 101/93.34 X |
| 3,745,495 | 7/1973 | Chai et al. | 335/229 |
| 3,802,543 | 4/1974 | Howard | 197/1 R |
| 3,850,278 | 11/1974 | Mihm et al. | 197/1 R |
| 3,890,587 | 6/1975 | Field | 335/255 |

*Primary Examiner*—Edward M. Coven
*Attorney, Agent, or Firm*—Robert R. Hubbard

[57] ABSTRACT

A ballistic print hammer assembly which includes a pivotally mounted print hammer driven by an electromagnetic actuator, characterized by low cost and ease of manufacture, high velocity and short dwell time. A rigid pivot upon which the hammer is mounted is simply secured to one side of a frame member. One end of the hammer is disposed in a slot of the armature of the electromagnetic actuator. The stator of the actuator is arranged to be inserted (by means of screw threads) from the other side of the frame member through an aperture so that the armature fits within the actuator stator cavity. An impression control spring is further disposed in a central cavity of the armature to continually produce a biasing force on the hammer which in the free-flight condition of the hammer is a decelerating force.

8 Claims, 4 Drawing Figures

BALLISTIC PRINT HAMMER ASSEMBLY

BACKGROUND OF INVENTION

A. Field of Invention

This invention relates to impact printing machines and in particular to a novel and improved ballistic print hammer assembly which is characterized by high velocity, short dwell time, low effective mass of the hammer head and low cost and ease of manufacture.

In impact printers the print hammer is actuated to cause an impact between a type carrier and a printing medium so as to result in a selected character being printed on the printing medium. In some printers the type carrier is stationary at the instant of impact and in others the type carrier is moving (on-the-fly) at the instant of impact. Because of its high velocity and short dwell time characteristics, the print hammer assembly of the present invention is especially useful in on-the-fly printers in which the type carrier is moving at such high speeds that short dwell times are necessary to avoid smear and/or tearing of the print medium. However, the simplicity of manufacture and low cost characteristics of the print assembly of this invention also make it attractive for lower speed on-the-fly printers and even in those impact printers in which the type carrier is stationary at the instant of impact.

In the context as used herein, the term "ballistic print hammer" means that at some point in the hammer's path of travel between its rest position and its printing position, the hammer is in a free-flight condition. This is generally achieved, for example, by initially applying an accelerating force to the hammer to move it from an initial rest position toward a printing position. However, before the hammer reaches the printing position the accelerating force is removed. Due to its inertia, the hammer then continues to move toward the printing position and to impact the printing medium with the type carrier.

B. Prior Art

One of the problems associated with the use of ballistic print hammers is that different amounts of kinetic energy of the hammer head are required to print single and multi-part forms. That is, more energy is required to print the multi-part form than to print the single part form. One prior art attempt to solve this problem involved the placement of damping pads at a forward stop location so as to absorb kinetic energy. A disadvantage of this technique is that it requires critical initial adjustments and also frequent field adjustments of the distance between the rest position of the hammer and the damping pads. Another prior art attempt to solve this problem involved varying the amount of energy applied to the actuator of the hammer. This generally involves applying a relatively high electric current for the multi-part form situation and a relatively low current for the single part form situation. The problem with this approach is that it changes the acceleration time of the hammer which in turn requires an elaborate and costly machine timing mechanism which can accommodate all of the acceleration conditions for all values of current employed in the approach.

BRIEF SUMMARY OF THE INVENTION

A print hammer assembly embodying the invention includes an elongated hammer with a head portion near one of its ends which is mounted on a rigid pivot. The other end of the hammer is coupled to the electromagnetic actuator armature near one of its ends. In addition to the elongated armature, the actuator includes an elongated stator having a generally cylindrical cavity extending from one of its ends. The stator is mounted in an aperture of a frame member so that the stator cavity faces a first side of the frame member. The pivot is then simply secured to the first side of the frame member so that the other end of the armature is disposed within the stator cavity.

In one embodiment, a return spring is coaxially mounted about the armature between a first spring stop located on the armature and a second spring stop located in the stator cavity.

In another embodiment, a portion of the stator is generally cylindrical and comprises screw threads about its outer surface. There are mating screw threads in the frame member aperture so as to facilitate ease of installing and removing the stator. In addition, this allows the relative positions of the stator and armature to be readily adjusted by manual rotation of the stator.

In still another embodiment of the invention, a portion of the armature near its one end (the one remote from the stator cavity) has a slot extending therethrough. The end of the hammer remote from the hammer head extends through this slot. An impression control spring means is located within a central armature cavity to continually urge the hammer toward the end of the slot remote from the stator cavity. When the stator is actuated, a lateral or axial motion to the armature and a corresponding rotational motion (about the pivot) is imparted to the hammer. The armature bottoms in the stator cavity prior to the hammer head portion reaching a printing position such that the hammer continues to rotate due to its rotational inertia toward the printing position in a free-flight condition. The duration of this condition is a function of the thickness of the print medium. During this time the impression control spring means continually acts upon the hammer to decelerate the hammer during the free-flight condition so that the rotational hammer velocity is relatively higher for a thick print medium than for a thin print medium. This is an important feature which allows the print hammer assembly to be used for both thick and thin print media without frequent adjustments.

BRIEF DESCRIPTION OF THE DRAWINGS

In the accompanying drawings, like reference characters denote like elements of structure.

DESCRIPTION OF PREFERRED EMBODIENT

Figure 1A:
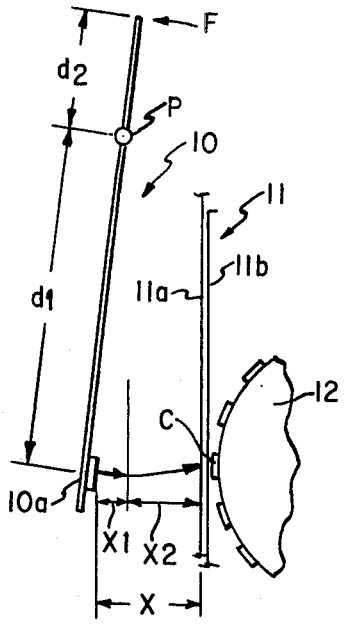
FIGS. 1A and 1B are outline views showing a portion of a printer apparatus in which print hammer assemblies embodying the present invention may be employed.
Figure 1B:
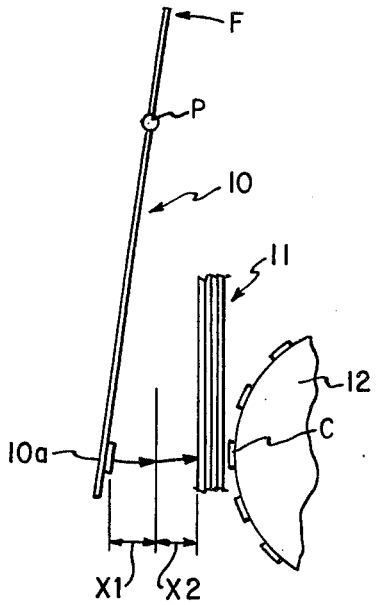

Before proceeding with a description of the structural detail of a print hammer assembly embodying the present invention, it is convenient to intitially describe the ballistic principles which are involved. FIGS. 1A and 1B show in outline form a portion of a printer including a typical print hammer 10, a printing medium 11 and a type carrier 12. The type carrier 12, by way of example and completeness of description, is illustrated as a rotatable print drum having type characters, such as C, arranged about its circumferential surface. It is to be noted that print hammer assemblies embodying the invention may also be employed with other forms of type carriers (for example, endless belts, spoked wheels and others).

The print hammer 10 (shown for illustrative purposes in skeletal or stick form) is an elongated member having a print hammer portion 10*a* near one of its ends. The hammer 10, which is shown in its rest position, is rotatable about a pivot P by means of applying a laterial or longitudinal force F to the other end of the hammer toward a printing position where the printing medium 11, consisting of paper 11*a* and an inked ribbon 11*b*, is impacted against the type character C to result in the printing on paper 11*a* of an image corresponding to the type character C. Although the hammer 10 must move a total distance of X from the rest position to the printing position, the force F is applied only until the hammer has moved a distance X1. When the force F is no longer applied, the hammer continues to move in a free-flight condition, due to its rotational inertia, through the remaining distance X2 to the printing position. After impact the hammer 10 rebounds and is returned to the rest position.

In a high speed printer application the type carrier drum 12 is rotating at a relatively high speed. In this application it is extremely important that the dwell time be extremely short. The dwell time is that time during which the hammer head 10*a* maintains the printing medium 11 in engagement with the type face C. If the dwell time is too long, the rapidly moving type face will cause the character being printed to be smeared. In order to achieve a short dwell time it is essential for the hammer head 10*a* to have a low effective mass and a high velocity at the time of impact. A low effective mass of the hammer head 10*a* is achieved by the use of rotational motion for the print hammer. A high hammer head velocity is achieved by proper placement of the pivot P intermediate the ends of the hammber 10. The velocity of the hammer head 10*a* is related to the velocity at its other end where the force is applied by the ratio *d*1 to *d*2, where *d*1 is the distance from the pivot P to the hammer head end and the distance *d*2 is the distance from the point P to the other end of the hammer. In one design embodying a print hammer assembly of the present invention a ratio of *d*1 to *d*2 on the order of three was employed so that the hammer head velocity is three times as great as the velocity of the other end of the hammer. Appropriate use of this mechanical advantage can result in significant savings in power required to produce the force F.

It is frequently required that a printer be capable of printing not only a single part form (one sheet of paper) but also multi-part forms (two or more sheets of paper plus one or more sheets of carbon). Due to the different thicknesses of the single and multi-part form print mediums, the distance X2 is variable. Thus, the distance X2 in FIG. 1B, which shows a multi-part form print medium 11, is smaller than in FIG. 1A for the single part form case. It is, of course, essential that the hammer head velocity at impact be greater for the multi-part form case than for the single part form. The problem is how to achieve a high enough velocity in the multi-part form situation to print all papers in the multi-form with clarity and also to achieve a low enough velocity to print the single form paper without puncturing or tearing the paper. As hereinbefore mentioned, prior attempts to solve this problem have been unsatisfactory. What is needed is a solution which solves the problem without the necessity of critical initial adjustments and frequent field adjustments or the necessity of elaborate timing circuits to allow for differing acceleration times of the print hammer. In short, it is desirable to have a print hammer assembly in which the distance X is easily set at the time of installation, in which field adjustments are seldom ncessary, and in which the velocity of the hammer head during the free-flight condition is easily and simply controlled to accommodate thin and thick paper media.

Figure 3:
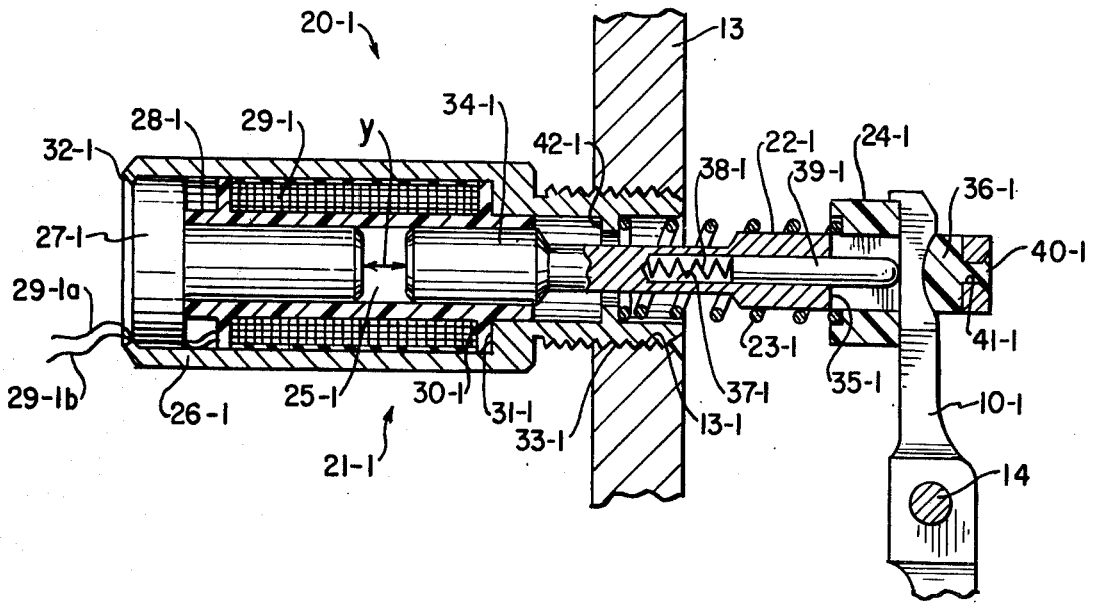
FIG. 3 is a cross-sectional view of the FIG. 2 print hammer assembly taken along lines 3–3'.
Figure 2:
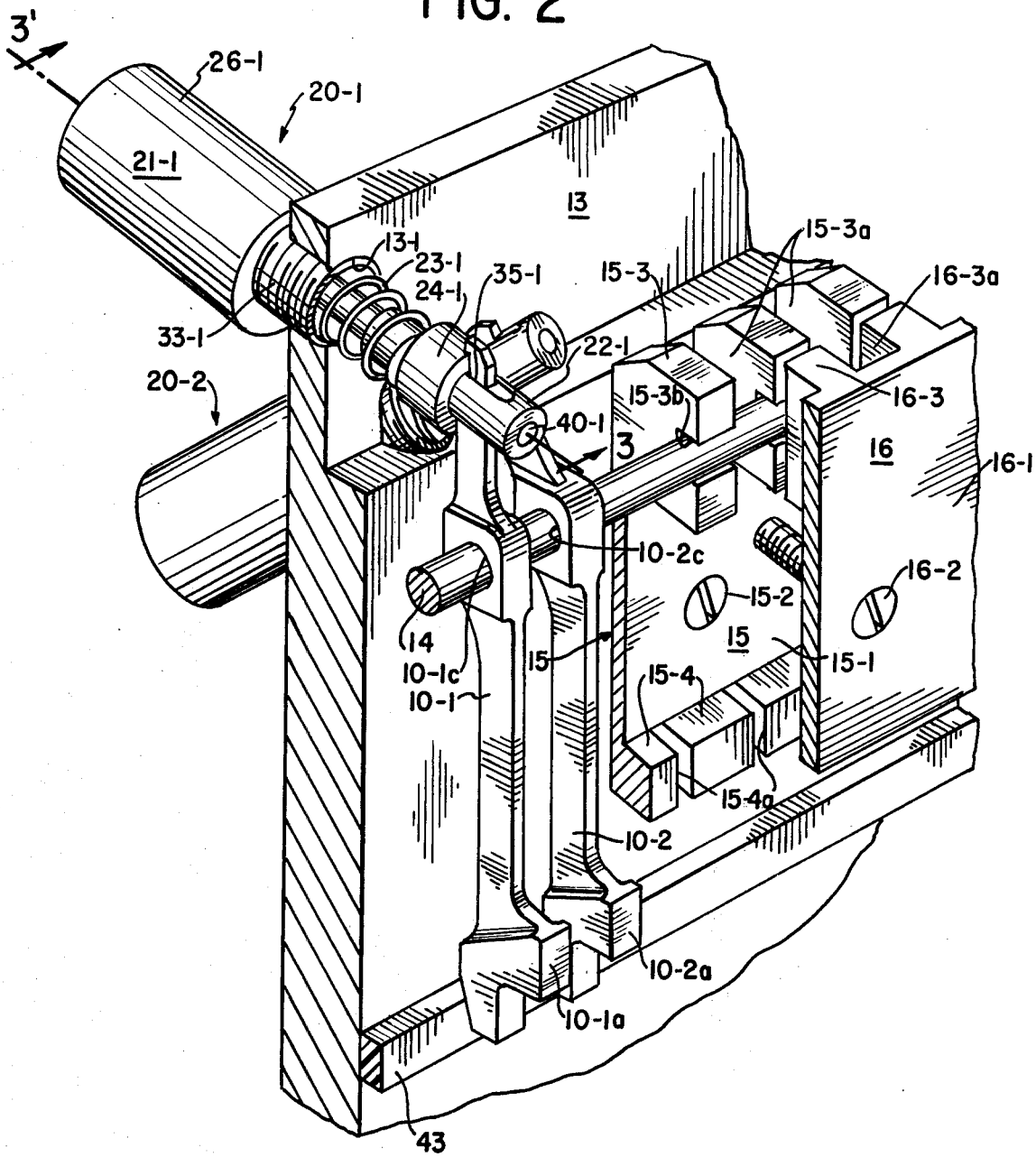
FIG. 2 is a perspective view of a print hammer assembly embodying the present invention.

Referring now to FIGS. 2 and 3, a ballistic print hammer assembly embodying the invention is shown to include a plurality of print hammers, of which only two are shown at 10-1 and 10-2. Associated with each hammber 10-1 and 10-2 is a corresponding electromagnetic actuating unit 20-1 and 20-2 which are rigidly secured to a printer frame member 13. Only enough of the frame member 13 has been shown to illustrate the simplicity of the print hammer assembly and the ease with which it can be assembled. As can be seen, a portion of the frame 13 has been broken away in order to conveniently illustrate the print hammer assembly.

Electromagnetic units 20-1 and 20-2 are oriented at an angle to one another in order to achieve close hammer head spacings. Despite the use of the angular orientation of the units 20-1 and 20-2, there is still a spacing between the hammers 10-1 and 10-2 as shown in FIG. 2. In order to achieve even closer spacing of the hammer heads, a substantially similar print hammer assembly (not shown) could be similarly secured to the frame 13 in such a manner as to have its hammer heads 10-1*a* and 10-2*a* of hammers 10-1 and 10-2. Although this is a technique which is well known in the art, suffice it to say here that such assembly would be mounted on the frame member 13 below the print hammers 10-1 and 10-2 with its hammers extending upwardly rather than downwardly and offset from the hammers 10-1 and 10-2 in order to achieve interleaving.

The hammers 10-1 and 10-2 are mounted on a pivot, shown as a rod 14, which is inserted through respective hammer apertures 10-1*c* and 10-2*c* such that the hammers are rotatable about the rod 14. The rod 14 is rigidly secured to the frame member 13 by means of clamping members 15 and 16 which actually extend along the entire length of the hammer assembly but have been broken to show the constructional detail of these hammers. Member 15 includes a flat plate portion 15-1 which abuts the surface of frame 13 and is rigidly secured thereto as by screw element 15-2. Projecting outwardly from plate portion 15-1 are upper and lower rails 15-3 and 15-4 which include vertical slots 15-3*a* and 15-4*a*. These slots are spaced from another and have appropriate slot widths so that adjacent ones of the hammers 10-1, 10-2 and the others (which are mounted on pivot rod 14, but not shown) can be fitted therein. The rail 15-3 includes a further horizontal slot 15-3*a* which is adapted to receive the pivot rod 14.

The clamping member 16 includes a flat plate portion 16-1 and an upper rail 16-3 having vertical slots 16-3*a* extending therethrough. The clamping member 16 is rigidly secured to the clamping member 15 and the frame 13 as by means of screw 16-2 so that the vertical slots 15-3*a* and 16-3*a* are in registration. The widths of these slots are slightly larger than the corresponding widths of the hammers so as to allow the hammers to move freely within the slotted areas. The depth of the horizontal slot 15-3*b* is approximately the diameter of the rod 14 so that the clamping member 16 is permitted to rigidly clamp the rod 14 and prevent its rotation. The clamping member 16 also includes a lower slotted rail member (not shown) with slot spacing corresponding to the spacings of the slots 15-4*a* in lower rail 15-4.

Still with reference to FIG. 2 and the cross-sectional view of FIG. 3, the electromagnetic unit 20-1 is shown to include a stator 21-1, an armature 22-1, a return spring 23-1 and a return spring retainer element 24-1. Since all the electromagnetic units are substantially identical in construction, only the unit 20-1 will be described in detail. The stator 21-1 is generally cylindrical in shape and has a generally cylindrical cavity 25-1 which is adapted to receive one end of the armature 22-1.

The stator, which is characterized by simplicity of construction, has only three major components, namely, a generally cylindrical metallic piece 26-1, a metallic plug element 27-1 and an inductor element consisting of a bobbin 28-1 and coil 29-1 which is wound upon the bobbin. The piece 26-1 and plug 27-1 form a part of the magnetic circuit of the stator and are preferably formed of a material exhibiting magnetic properties such as soft iron, low carbon steel, and the like.

These stator parts are relatively easy to assemble. The bobbin and coil assembly 28-1 and 29-1 is first inserted into the hollow cylindrical portion of the iron piece 26-1 such that the outwardly projecting flange 30-1 of the bobbin abuts a shoulder 31-1 of the piece 26-1. The plug 27-1 is then inserted into the central bore of the bobbin 28-1. The final step in assembling the stator is then to fold the lip portion 32-1 of the piece 26-1 over the end of the plug 27-1. At this point it should be further noted that the stator 21-1 has a screw threaded portion 33-1 which facilitates its mounting in a screw threaded aperture 13-1 of the frame member 13.

Th armature 22-1 is an elongated member of which at least the end portion 34-1 is generally cylindrical so as to mate with the generally cylindrical cavity 25-1 in the stator. Near the other end of the armature is a slot 35-1 which extends entirely through the armature and which is adapted to receive the end of the hammer 10-1 remote from the hammer head portion 10-1*a*. A bushing or bearing element 36-1 is mounted in the extreme right-hand end of the armature. The contours of the bushing 36-1 and the hammer portion 10-1 within the slot 35-1 are shaped so as to mate one another. The bushing 36-1 therefore serves as a bushing or guide as well as a bearing for rotational motion of the hammer 10-1.

A central armature cavity 37-1 extends from the other end of the armature slot toward the armature portion 34-1 which is located within the stator cavity 25-1. An impression control spring means consisting of a spring 38-1 and a pin element 39-1 is disposed within the armature cavity such that the pin 39-1 extends outwardly from the cavity and into the slot 35-1. The spring 37-1 is in compression so as to continuously urge the pin 39-1 against the hammer 10-1 so as to hold the hammer against the bushing 36-1.

The armature 22-1 is also rather simple to assemble. First, the spring 38-1 and pin 39-1 are inserted into the armature cavity 37-1. Next, a stem portion 40-1 of the bushing 36-1 is inserted into an aperture 41-1 in the right-hand end of the armature. The aperture 41-1 is slightly countersunk so that suitable application of heat (as by a soldering iron or other heating tool) will allow the plastic which forms the bushing to flow within the countersink and firmly secure the bushing 36-1 to the end of the armature.

The final step of the print hammer assembly involves the assembled stator 21-1, the assembled armature 22-1, the hammer 10-1, the pivot rod 14 and the clamping members 15 and 16. Clamping member 15 is secured to the plate 13 and the stator 21-1 is screwed into the threaded aperture 13-1. The armature portion 34-1 is inserted into the cavity 25-1. The return spring 23-1 is slipped over the end of the armature until it rests upon the flanged stop member 42-1 formed in the stator cavity. The annular return spring retainer element 24-1 is then slipped over the end of the armature to engage the return spring. Next, the spring retainer ring 24-1 is moved far enough toward frame 13 (spring rate of the return spring is extremely low so that this can be done manually) so that the end of hammer 10-1 can be inserted through the armature slot 35-1. It should be noted that preferably the annular spring retainer ring has a vertical slot in which the hammer 10-1 fits so as to assist in preventing side-to-side motion of the hammer end within the slot. At the same time the hammer 10-1 is fitted into an associated one of the vertical slots 15-3*a* of the clamping member 15. The remaining hammers are assembled in substantially the same way, after which the rod 14 is inserted through the hammer apertures (10-1*c* and 10-2*c*) and the horizontal slot 15-3*b* in member 15. Finally, the plate 16 is secured to the frame 13 so as to make the mounting of the pivot 14 rigid.

Due to the motion of the armature and hammer, the bushing 36-1, the pin 39-1 and the spring retainer element 24-1 are all preferably formed of a self-lubricating plastic material, such as molybdenum disulfide filled thermoplastic.

In the operation of the print hammer assembly, an electric signal (produced by a source of hammer actuating signals, not shown) is applied by way of leads 29-1*a* and 29-1*b* which are connected to the coil 29-1 so as to produce a magnetic field within the stator cavity 25-1 which in turn causes the armature to move in a lateral or axial direction into the stator cavity. This motion of the armature corresponds to the force F in FIG. 1*a* and acts to impart rotational motion to the hammer 10-1. In FIG. 3 the armature is shown at its rest position in which there is a gap *y* between the end of the armature and the end of the stator plug 27-1. This gap or distance *y* determines the distance X1 (see FIGS. 1A and 1B) through which the hammer is moved with an accelerating force and therefore the point at which the force is removed so that the hammer enters into a free-flight condition. One of the significant features of the present invention is that this gap *y* is easily adjustable by merely turning the stator either clockwise or counterclockwise in the threaded aperture 13-1.

As the armature 22-1 is drawn into the stator cavity 25-1, it exerts a force in the same direction on the end of the hammer 10-1. It is believed that this force, together with the bottoming of the armature 22-1, causes the end of the hammer 10-1 to move slightly away from the bushing 36-1 toward the stator. The impression control spring means, consisting of the spring 38-1 and the pin 39-1, acts to continually apply a force in the opposite direction on the end of the hammer 10-1.

During the time that the hammer is in the free-flight condition, this force acts to enhance the deceleration of the hammer head 10-1*a* and hence, to decrease its velocity more and more the farther it must travel. This is important for the application which requires both thin and thick printing mediums. When the print hammer impacts the printing medium against the type carrier, the hammer rebounds and is much more slowly returned to its rest position. At the rest position the return energy of the hammers 10-1 and 10-2 is absorbed by a backstop element 43 mounted on frame 13. The backstop element 43 may be made out of a suitable energy-absorbing material such as a urethane plastic.

It is to be noted that the impression control spring 38-1 has a much higher spring rate than the return spring 23-1. For example, in one design embodying the invention, the spring rate of the impression control spring is several orders of magnitude higher than the spring rate of the return spring. This is to assure that the spring 38-1 has the ability to apply a decelerating force to the hammer 10-1 during the free-flight condition. On the other hand, the spring rate of return spring 23-1 can be rather low, as its primary purpose is to provide a boost to the rebound energy of the hammer in returning it to the rest position.

While a preferred embodiment of the invention has been shown in the drawings, it is to be understood that this disclosure is for the purpose of illustration only and that various changes in shape, proportion and arrangement of parts, as well as the substitution of equivalent elements for that herein shown and described, may be made without departing from the spirit and scope of the invention set forth in the appended claims.

What is claimed is:

1. In a print hammer assembly having an elongated hammer with a head portion near one of its ends and being mounted on a rigid pivot, the other end of the hammer being coupled to the armature of an electromagnetic actuator, the actuation of the actuator imparting axial motion to the armature and rotational motion to the hammer about the pivot from a rest position to a printing position in which a printing medium and a type character situated on a type carrier are impacted into engagement, the improvement comprising:

said electromagnetic actuator including said armature and a stator having a generally cylindrical cavity which has a bottom and a mouth, said armature being elongated and partially disposed within said cavity so that a portion thereof extends outside the cavity mouth, an elongated slot extending through said portion, said slot having first and second ends, and a central armature cavity having a bottom and a mouth which opens into the first end of the armature slot;

the other end of the hammer extending through said slot and being adapted for motion within the slot between its first and second ends;

impression control spring means located within said armature cavity and arranged to continually urge said hammer toward the second end of the slot; and means for actuating the stator to produce said axial and rotational motions of the armature and hammer, said armature bottoming against the stator cavity bottom prior to the hammer head portion reaching the printing position such that the hammer continues to rotate due to its rotational inertia toward the printing position in a free-flight condition, the duration of which is a function of the thickness of the print medium, the impression control spring means continually acting upon the other end of the hammer to decelerate the hammer during the free-flight condition so that the rotational hammer velocity is relatively higher for a thick print medium than for a thin print medium.

2. A print hammer assembly as set forth in claim 1 and further including:

a return spring coaxially mounted about said armature, said return spring having a relatively lower spring rate than that of the impression control spring means; and sad armature including a first spring stop and said stator cavity including a second spring stop and said return spring being held in compression between the first and second stops.

3. A print hammer assembly as set forth in claim 2 wherein said impression control spring means includes an impression control spring and a pin which are arranged on a common axis with the impression control spring having one of its ends engaging the bottom of the armature cavity and the other of its ends engaging one end of the pin, the other end of the pin engaging said other end of the hammer.

4. A print hammer assembly as set forth in claim 3 and further including a rigid frame member having an aperture extending between first and second sides thereof;

means for mounting said stator in said frame member aperture so that the stator cavity faces the first side of the frame member; and means for securing said pivot to the first side of the frame member such that the armature is partially disposed within the stator cavity.

5. A print hammer assembly as set forth in claim 4 wherein at least a portion of the stator is generally cylindrical; and wherein the stator mounting means comprises screw threads upon the cylindrical portion of the stator and mating screw threads on the frame member aperture such that the relative positions of the stator and armature are readily adjustable by manual rotation of the stator.

6. A print hammer assembly as set forth in claim 5 wherein said elongated hammer is one of a plurality of hammers all of which are mounted on said rigid pivot with said rigid pivot being secured to the first side of the frame member;

wherein said actuator is one of a like plurality of electromagnetic actuators and said aperture is one of a like plurality of apertures extending through the rigid frame member, one aperture and one actuator for each hammer; and wherein the stators of said actuators are mounted in corresponding ones of the frame member pertures such that the corresponding armatures are disposed within the corresponding stator cavities and are coupled to the corresponding hammers.

7. In a print hammer assembly having an elongated hammer with a head portion near one of its ends and being mounted on a rigid pivot, an electromagnetic actuator having (1) a stator which has an axial cavity with a bottom and a mouth and (2) an elongated armature which is partially disposed within the stator cavity, means for coupling the other end of the hammer to the armature, the energization of the actuator imparting axial motion to the armature and rotational motion of the hammer about the pivot from a rest position to a print position; said coupling means being characterized by an elongated slot extending through a portion of the armature, which portion extends outside the stator cavity mouth, with the other end of the hammer extending through the slot and being adapted for motion within such slot and by means for continually maintaining said other end of the hammer within the slot when the armature and hammer are in motion and when the armature and hammer are in the rest position, said assembly further including a rigid frame member having an aperture extending between first and second sides thereof means including screw threads on the outer surface of the stator and mating screw threads in the aperture to mount the stator in the frame member, so that the stator cavity mouth faces the first side of the frame member means for securing the pivot to the first side of the frame member, and a return spring operatively engaging the armature and the stator, and arranged to bias the armature away from the stator cavity bottom a desired distance which is adjustable by manual rotation of the stator.

8. A print hammer assembly as set forth in claim 7 wherein said elongated hammer is one of a plurality of hammers all of which are mounted on said rigid pivot with said rigid pivot being secured to the first side of the frame member;

wherein said actuator is one of a like plurality of electromagnetic actuators and said aperture is one of a like plurality of apertures extending through the rigid frame member, one aperture and one actuator for each hammer; and wherein the stators of said actuators are mounted in corresponding ones of the frame member apertures such that the corresponding armatures are disposed within the corresponding stator cavities and are coupled to the corresponding hammers.

* * * * *